US008604326B2

(12) United States Patent
Ellis

(10) Patent No.: US 8,604,326 B2
(45) Date of Patent: Dec. 10, 2013

(54) DUAL SUSTAIN SINGLE KEYBOARD PEDAL

(75) Inventor: Curtis Mitchell Ellis, Moore, SC (US)

(73) Assignee: Curtis Mitchell Ellis, Moore, SC (US)

( * ) Notice: Subject to any disclaimer, the term of this patent is extended or adjusted under 35 U.S.C. 154(b) by 672 days.

(21) Appl. No.: 12/799,956

(22) Filed: May 5, 2010

(65) Prior Publication Data

US 2011/0030534 A1 Feb. 10, 2011

Related U.S. Application Data

(60) Provisional application No. 61/273,677, filed on Aug. 7, 2009.

(51) Int. Cl.
*G10C 3/12* (2006.01)

(52) U.S. Cl.
USPC ..... 84/426; 84/738; 84/746

(58) Field of Classification Search
USPC ..... 84/426
See application file for complete search history.

(56) References Cited

U.S. PATENT DOCUMENTS

| | | | | | |
|---|---|---|---|---|---|
| 3,697,664 | A | * | 10/1972 | Hiyama | 84/715 |
| 4,276,801 | A | * | 7/1981 | Yerusavage | 84/715 |
| 4,617,851 | A | | 10/1986 | Sato | |
| 4,829,869 | A | * | 5/1989 | Katada et al. | 84/622 |
| 5,166,467 | A | | 11/1992 | Brown | |
| 5,241,130 | A | | 8/1993 | Shibukawa | |
| 5,535,642 | A | * | 7/1996 | Moll | 74/561 |
| 5,550,321 | A | | 8/1996 | Brann | |
| 5,786,540 | A | | 7/1998 | Westlund | |
| 5,834,671 | A | | 11/1998 | Phoenix | |
| 5,981,862 | A | | 11/1999 | Geier, Jr. | |
| 6,459,023 | B1 | | 10/2002 | Chandler | |
| 6,545,204 | B1 | | 4/2003 | Wadell | |
| 7,326,849 | B2 | | 2/2008 | Adams et al. | |
| 7,525,038 | B2 | | 4/2009 | Yamada | |
| 2007/0017353 | A1 | * | 1/2007 | Kunisada et al. | 84/723 |
| 2008/0129695 | A1 | | 6/2008 | Li | |
| 2008/0229914 | A1 | | 9/2008 | Nathanial | |

OTHER PUBLICATIONS

O1XRAY.com; Web site print outs from http://www.01xray.com/forums/showflat.php?Cat=1,2,4&Board=Live&Number=370787&page=0&view=collapsed&sb=5&o; visited Apr. 29, 2010; copyright 2007; copyright O1Xray; (2 pages).

Roland Corporation; Web site print out from http://www.roland.com/products/en/RPU-3/; visited Dec. 27, 2010; copyright 1999-2010; copyright Roland Corporation; (1 page).

zZounds Music, LLC; Web site print outs from http://www.zzounds.com/item—ROLRPU3; visited Jan. 5, 2011; copyright 1996-2011; copyright zZounds Music, LLC; (4 pages).

* cited by examiner

*Primary Examiner* — Christopher Uhlir

(57) ABSTRACT

A sustain foot pedal for sustaining a first keyboard and a second keyboard that may have first and second switches is provided. The pedal has an actuating member that may simultaneously activate both the first and second switch. A first keyboard receives a first sustain signal upon activation of the first switch and sustains a first note upon receipt of the first sustain signal. A second keyboard receives a second sustain signal upon activation of the second switch and sustains a second note upon receipt of the second sustain signal. The keyboards are independent from one another such that the first keyboard does not send a signal to the second keyboard to control the second keyboard, and such that the second keyboard does not send a signal to the first keyboard to control the first keyboard.

7 Claims, 6 Drawing Sheets

DUAL SUSTAIN SINGLE KEYBOARD PEDAL

CROSS REFERENCE TO RELATED APPLICATIONS

This application claims the benefit of U.S. Application Ser. No. 61/273,677 filed on Aug. 7, 2009 and entitled, "Dual Sustain Single Pedal (DSSP)." U.S. Application Ser. No. 61/273,677 is incorporated by reference herein in its entirety for all purposes.

FIELD OF THE INVENTION

The present invention relates generally to keyboard pedals. More particularly, the present application involves a sustain foot pedal capable of sustaining notes on two different keyboards when both of the different keyboards are played at the same time during a performance by a musician.

BACKGROUND

A trend that is becoming more common in musical performances that include keyboards is the use of stacks. Stacks are multiple keyboards that are played by a single musician. In this regard, a first keyboard is positioned in front of the musician and a second keyboard is located generally above the first keyboard and also within range of the musician. The musician may then play both keyboards during a musical performance. This arrangement allows for the production of multiple sounds. For example, the first keyboard can produce sounds similar to a guitar and to another stringed instrument, and the second keyboard can produce sounds similar to a horn and to other brass instruments. Further, as a practical matter the use of stacks eliminates the need to have an additional musician to play a second keyboard thus allowing the musicians to perform or practice in fewer numbers.

Although one could play two keyboards that are from the same manufacturer, this is not ideal. The reason for this is that keyboards produced by different manufacturers make different sounds even if they have similar settings. As such, a keyboard from one manufacturer may be best to play certain types of sound, while a different keyboard from a different manufacturer is better suited for playing a different type of sound set. As such, to achieve maximum benefit from playing stacks, it is preferred to use a first keyboard from one manufacturer and a second keyboard from a different manufacturer.

Performing on a pair of keyboards at a single time poses certain challenges to the musician. Keyboard players may purchase a sustain pedal that is a foot pedal that is depressed by the foot of the player. Doing so causes the note that is being played by the keyboard to be sustained. When two keyboards are employed, the musician must operate a sustain foot pedal for the first keyboard and a separate sustain foot pedal for the second keyboard. As such, there remains room for increasing focus and for variation and improvement within the art.

BRIEF DESCRIPTION OF THE DRAWINGS

A full and enabling disclosure of the present invention, including the best mode thereof, directed to one of ordinary skill in the art, is set forth more particularly in the remainder of the specification, which makes reference to the appended Figs. in which.

Figure 1:
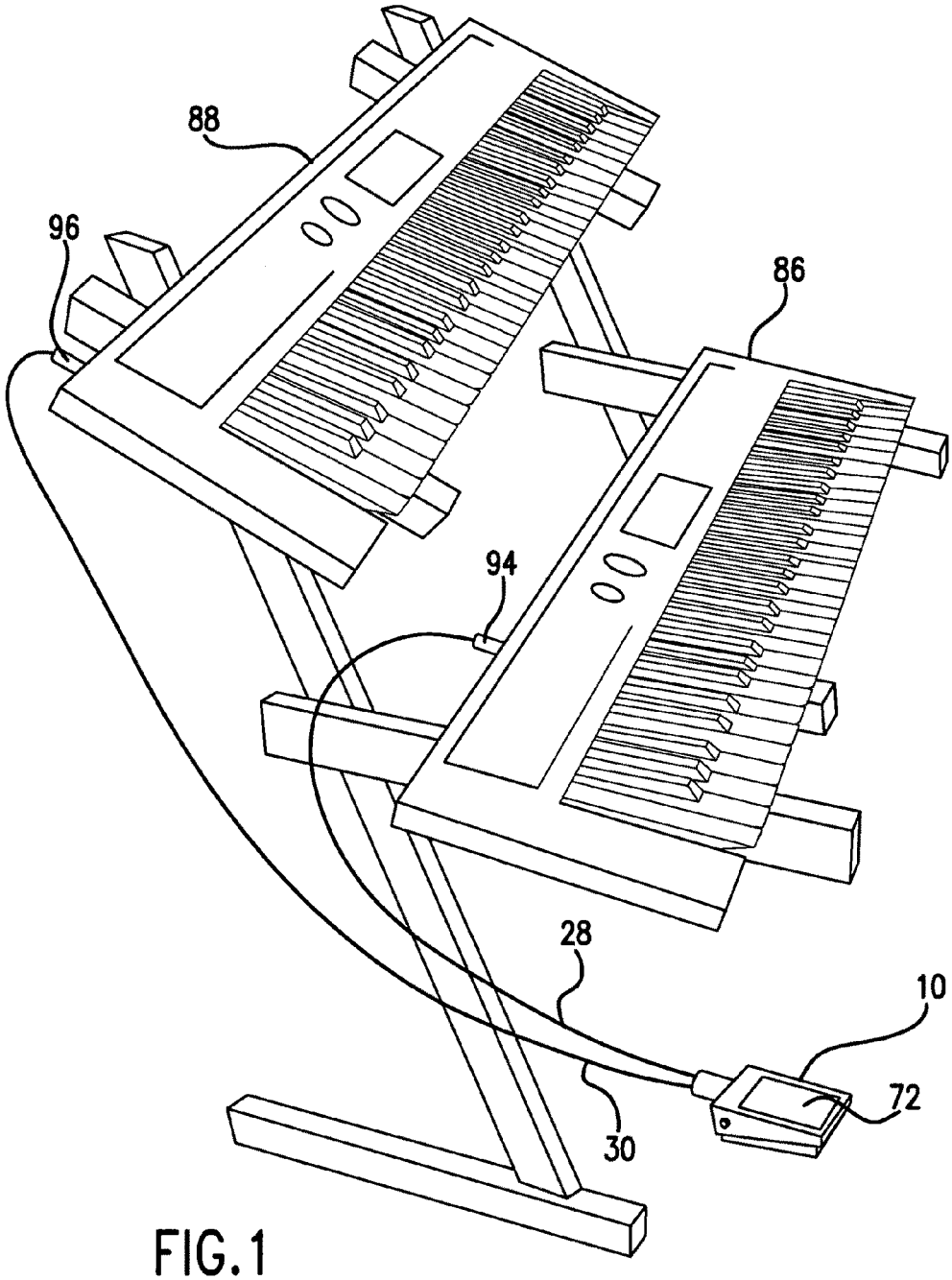
FIG. 1 is a general perspective view of a sustain foot pedal and a stack of keyboards.

Repeat use of reference characters in the present specification and drawings is intended to represent the same or analogous features or elements of the invention.

DETAILED DESCRIPTION OF REPRESENTATIVE EMBODIMENTS

Reference will now be made in detail to embodiments of the invention, one or more examples of which are illustrated in the drawings. Each example is provided by way of explanation of the invention, and not meant as a limitation of the invention. For example, features illustrated or described as part of one embodiment can be used with another embodiment to yield still a third embodiment. It is intended that the present invention include these and other modifications and variations.

It is to be understood that the ranges mentioned herein include all ranges located within the prescribed range. As such, all ranges mentioned herein include all sub-ranges included in the mentioned ranges. For instance, a range from 100-200 also includes ranges from 110-150, 170-190, and 153-162. Further, all limits mentioned herein include all other limits included in the mentioned limits. For instance, a limit of up to 7 also includes a limit of up to 5, up to 3, and up to 4.5.

The present invention provides for a sustain foot pedal 10 that is capable of sustaining a pair of keyboards 86 and 88. In this regard, the sustain foot pedal 10 may send a first signal to the first keyboard 86 when the sustain foot pedal 10 is actuated. Also, upon actuation of the sustain foot pedal 10 a second signal can be sent to the second keyboard 88 to instruct the second keyboard 88 to sustain a note. The first and second signals to sustain may be generated at the same time by the sustain foot pedal 10. The first keyboard 86 and the second keyboard 88 may be made by different manufacturers and may each require the same or different types of sustain signals to be input therein in order to effect sustaining of the notes.

One exemplary embodiment of the present invention is illustrated in FIG. 1. Here, a sustain foot pedal 10 is used in combination with a keyboard stack that includes the first keyboard 86 and the second keyboard 88. Different manufacturers may make the keyboards 86 and 88. In this regard, a manufacture may produce the first keyboard 86, while a different manufacturer makes the second keyboard 88. Musicians performing with multiple keyboards will use keyboards made by different manufacturers because the sounds generated by keyboards of different manufactures are unique and distinctive. In this regard, a particular keyboard may be best suited for playing certain types of sounds, while a different keyboard is better suited at playing a different sound set. The sustain foot pedal 10 can be actuated by a musician in order to simultaneously sustain notes played by both the first keyboard 86 and the second keyboard 88. The sustain signal from the sustain foot pedal 10 is transmitted to the first keyboard 86 via a first communication line 28, and the sustain signal from the sustain foot pedal 10 to the second keyboard 88 is transmitted via a second communication line 30 that is separate from the first communication line 28. As such, the communication lines 28 and 30 may be arranged so that they are separate from one another and do not communicate with one another.

The first keyboard 86 can be arranged so that timbre settings of the first keyboard 86 overlap with timbre settings of the second keyboard 88. In this regard, some of the timbre settings of the first keyboard 86 are unique to the first keyboard 86 and are not found in the second keyboard 88, while other timbre settings of the second keyboard 88 are unique to the second keyboard 88 and are not present in the first keyboard 86 when the keyboards 86 and 88 are simultaneously played. However, some timbre settings in the first keyboard 86 are the same as those in the second keyboard 88 when the keyboards 86 and 88 are simultaneously played. However, other exemplary embodiments exist in which no timbre settings overlap between the keyboards 86 and 88 when the keyboards 86 and 88 are simultaneously played. The first keyboard 86 may be completely independent from the second keyboard 88 so that data from the first keyboard 86 cannot be transferred to the second keyboard 88 and so that data from the second keyboard 88 cannot be transferred to the first keyboard 86. In this regard, the data may be sustain signals, timbre information, volume control, or any other piece of information. The first keyboard 86 and second keyboard 88 may be connected to the same power supply. However, apart from this connection, the only other connection between the keyboards 86 and 88 is the sustain foot pedal 10, and signals such as control signals between the two keyboards 86 and 88 are not sent from one to the other. Thus, the keyboards 86 and 88 may be arranged so that they are incapable of ever sending data to one another. Additionally, the keyboards 86 and 88 may be arranged so that a common computer to both the keyboards 86 and 88 does not control the keyboards 86 and 88. The keyboards 86 and 88 are thus completely independent from one another and their timbres, volume, and other sounds are not controlled by a common computer. However, it is to be understood that the term common computer does not include a power source used to provide electrical power to the keyboards 86 and 88 and does not include the sustain foot pedal 10.

Figure 2:
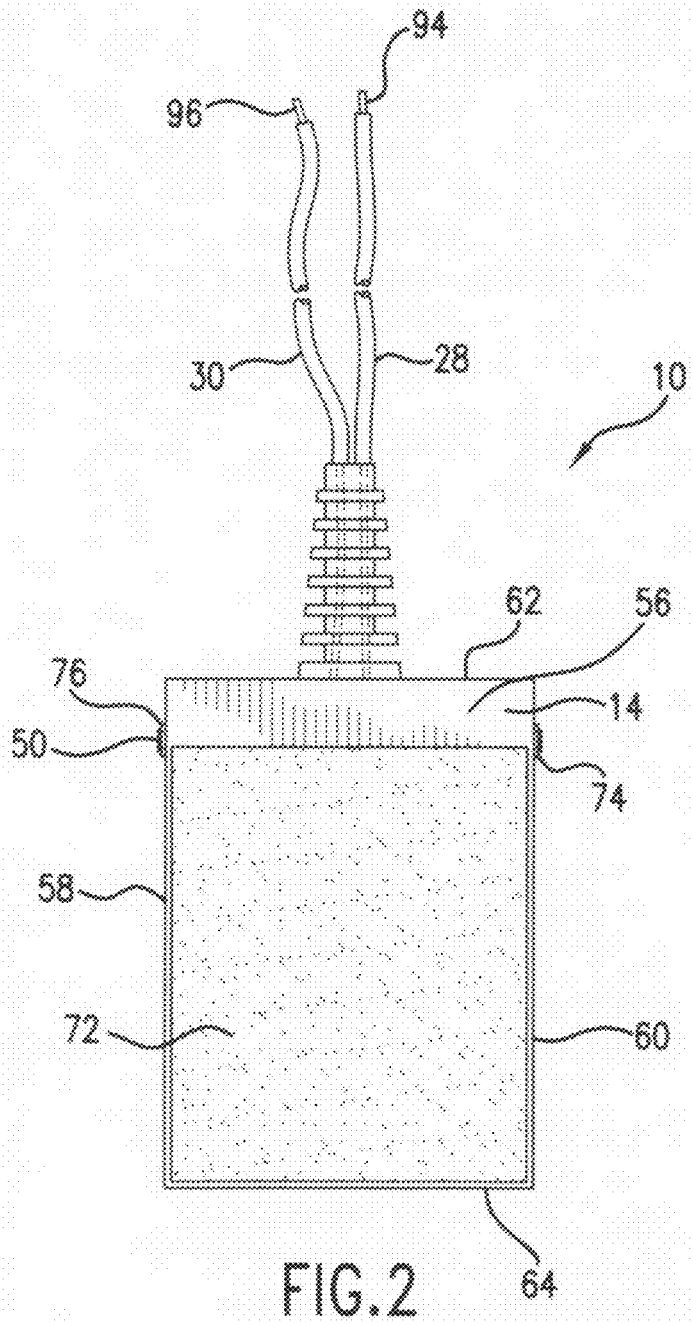
FIG. 2 is a top view of a sustain foot pedal in accordance with one exemplary embodiment.

A top view of a sustain foot pedal 10 in accordance with one exemplary embodiment is illustrated in FIG. 2. The musician is presented with an activating member 14 at the top of the sustain foot pedal 10 that has a top wall 56 onto which a slip resistant material 72 is situated. The musician may place his or her foot onto the activating member 14 and depress same in order to generate the pair of sustain signals. The slip resistant material 72 may be rubber or other material designed to provide frictional gripping between the foot of the user and the top wall 56 to ensure the foot of the user does not slide from the sustain foot pedal 10 during a performance. The end of the first communication line 28 includes a plug 94 that is received within a corresponding female receptacle of the first keyboard 86. In a similar manner, the second communication line 30 has a plug 96 that is received within a corresponding female receptacle of the second keyboard 88. However, it is to be understood that other arrangements are possible in which plugs 94 and 96 are not used and in which the communication lines 28 and 30 are placed into communication with the keyboards 86 and 88 in a variety of manners.

Figure 3:
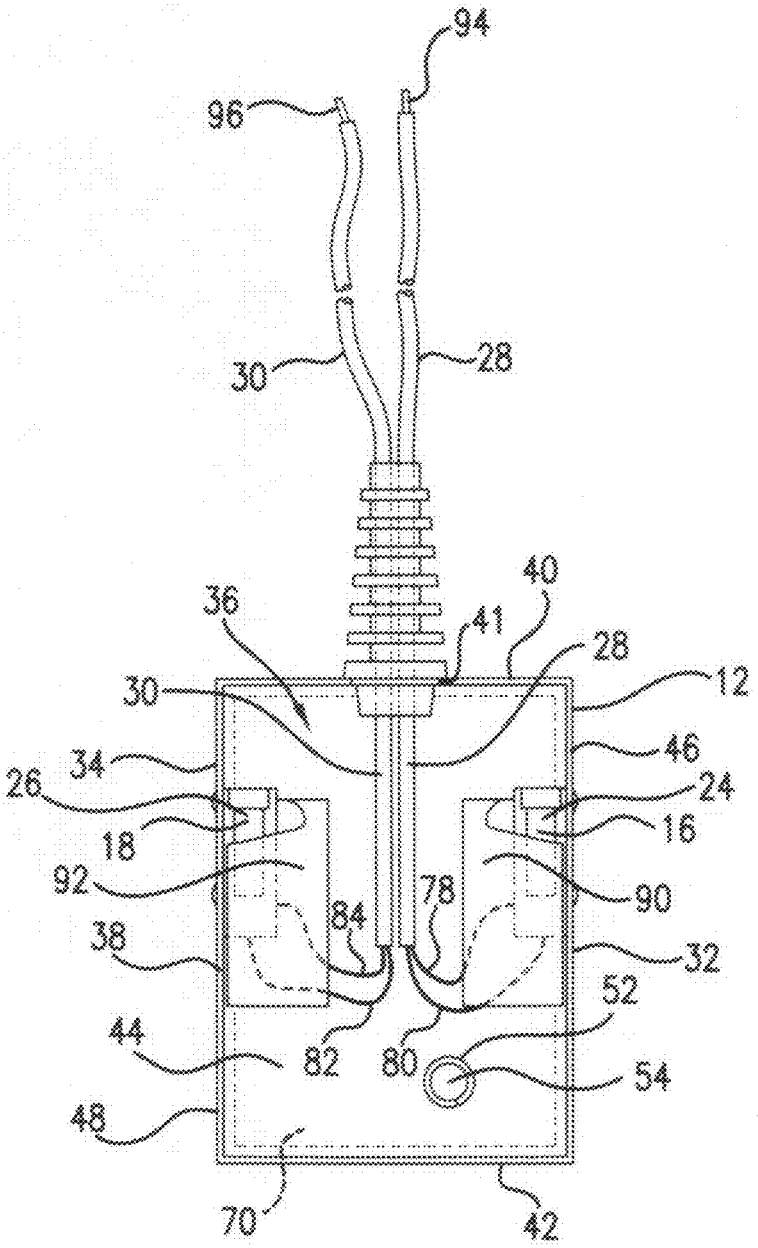
FIG. 3 is a top view of the sustain foot pedal of FIG. 2 with an actuating member removed.

The actuating member 14 is removed in FIG. 3 in order to illustrate additional components of the sustain foot pedal 10. A body 12 may be included and can be made of metal or plastic. The body 12 may have a series of walls such as a first side wall 32 and an oppositely disposed second side wall 34 that are parallel to one another and are on opposite sides of the body 12. A perpendicular front wall 40 may extend from the first side wall 32 to the second side wall 34. A back wall 42 can be disposed opposite from the front wall 40 and may be parallel to the back wall 42. The walls 32, 34, 40 and 42 may all extend from and be perpendicular to a bottom wall 44 of the body 12. Portions of the body 12 and the actuating member 14 may define an interior 36 into which certain portions of the sustain foot pedal 10 are disposed. An opening 41 is defined through the front wall 40 and may be located below a shaft 50 in the vertical direction 38 of the sustain foot pedal 10. The first communication line 28 and the second communication line 30 are disposed through the opening 41 so that the first and second communication lines 28 and 30 can be run from the interior 36 to the exterior of the sustain foot pedal 10 through the front wall 40.

A first switch 16 is attached to the first side wall 32, and a second switch 18 is attached to the second side wall 34. However, it is to be understood that the switches 16 and 18 need not be attached to the side walls 32 and 34 as shown in other exemplary embodiments. For example, the switches 16 and 18 may be attached to the same wall, to the bottom wall 44, or to the front or back walls 40 and 42 in other exemplary embodiments. The first communication line 28 includes a pair of wires 78 and 80 that are each in communication with the first switch 16. The second communication line 30 has a first wire 82 and a second wire 84 that are each in communication with the second switch 18. The switches 16 and 18 may be electrical components that either open or close an electrical circuit upon their activation or deactivation. For example, the first switch 16 may be a normally open switch such that the wires 78 and 80 form a portion of a circuit through which voltage flows. The open switch 16 creates a break in the circuit so that voltage will not flow through the wire 78 and into wire 80 through the first switch 16. The first keyboard 86 is in communication with the first communication line 28 and hence the first switch 16 and may be arranged so that it does not sustain a note when the circuit extending through the plug 94, first communication line 28 and switch 16 is open and not completed. Upon activation of the first switch 16, the aforementioned circuit is closed such that voltage may travel from the first keyboard 86 to plug 94 to wire 78 to switch 16 to wire 80 to plug 94 and finally back to the first keyboard 86. Completion of this circuit instructs the first keyboard 86 to sustain a note. The first communication line 28 may be a dedicated line to the first keyboard 86, and the second communication line 30 may be a dedicated line to the second keyboard 88.

The first switch 16 may alternatively be arranged so that it is a normally closed switch. With such an arrangement, the circuit aforementioned is closed and complete when the first switch 16 is not activated. The first keyboard 86 is arranged so that it does not sustain a note when the circuit is complete but does sustain a note when the circuit is open. The first switch 16 can be activated to disrupt or open the circuit thus instructing the first keyboard 86 to sustain a note. The sustain foot pedal 10 can be arranged so that both switches 16 and 18 are normally open, so that both switches 16 and 18 are normally closed, or so that one switch 16 is normally open while the other switch 18 is normally closed. Some keyboard manufacturers design keyboards so that they require a normally closed switch to sustain a note, and other keyboard manufacturers design keyboards so that they require a normally open switch to sustain a note. The musician may thus select the sustain foot pedal 10 so that the signals provided by the first and second communication lines 28 and 30 are correct for the particular keyboards 86 and 88 that are desired to be operated by the sustain foot pedal 10. The second switch 18 and its associated components such as the first wire 82 and the second wire 84 may be arranged in a manner similar to that of the first switch 16 and its components and a repeat of this information is not necessary.

Figure 4:
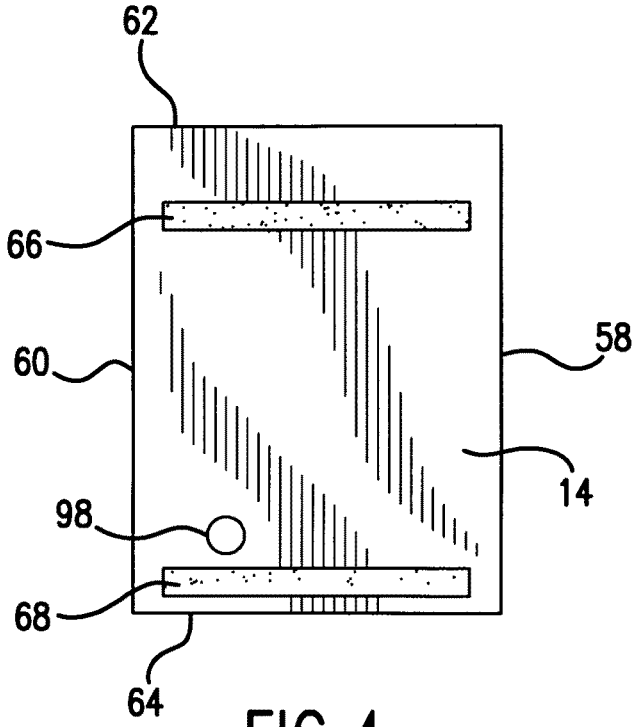
FIG. 4 is a bottom view of the actuating member of the sustain foot pedal of FIG. 2.

A projection 54 extends upwards from the bottom wall 44. A spring 52 may be disposed onto the projection 54 in order to help retain the spring 52 in a desired location. The other end of the spring 52 may rest against the bottom of the top wall 56 of the actuating member 14. A bottom view of the actuating member 14 is illustrated in FIG. 4. Here, a projection 98 extends from the bottom of the top wall 56 and may be used in a manner similar to projection 54 to help retain the location of the spring 52. The actuating member 14 may be made of metal or plastic and can have a series of walls that extend from the top wall 56. For example, a right side wall 58 and a left side wall 60 may extend from the top wall 56 and can be parallel to one another. The right side wall 58 and the left side wall 60 can be shaped in an identical manner as one another and may thus be mirror images of one another. The walls 58 and 60 can have upper edges that are linear and can have angled lower bottom edges that are linear but are not straight all the way across. An additional wall may extend from the right side wall 58 to the left side wall 60 and may be contiguous therewith. In some exemplary embodiments, the additional wall may be a front wall 62 that can extend between the side walls 58 and 60 and may be perpendicular to the side walls 58 and 60. In another embodiment the additional wall may be a back wall 64 that may extend between the side walls 58 and 60 as well and may be parallel to the front wall 62. The additional wall may be a different wall from that discussed in other arrangements. Noise reduction strips 66 and 68 may be located on the bottom of the top wall 56. The noise reduction strips 66 and 68 may be made of rubber or plastic or other material that dampens noise generated upon contact with the body 12. Actuation of the actuating member 14 will cause the noise reduction strip 66 to come into contact with the top edge of the front wall 40, and will cause the noise reduction strip 68 to come into contact with the top edge of the back wall 64. Noise associated with this contact will be eliminated or reduced by the presence of the noise reduction strips 66 and 68. However, it is to be understood that other arrangements of the sustain foot pedal 10 exist in which the noise reduction strips 66 and 68 are not present. The noise reduction strips 66 and 68 thus help reduce noise associated between engagement of the actuating member 14 and body 12 when one actuates the actuating member 14 during a performance.

An interior 36 of the sustain foot pedal 10 may be defined by the body 12 and the actuating member 14. In particular, the interior 36 may be defined by the first side wall 32, second side wall 34, front wall 40, back wall 42, bottom wall 44 and top wall 56 when the actuating member 14 is in the second position 22. When the actuating member 14 is in the first position 20 the interior 36 may be defined by the first side wall 32, second side wall 34, front wall 40, back wall 42, bottom wall 44, top wall 56, right side wall 58, left side wall 60, front wall 62 and back wall 64. Components such as the first switch 16, second switch 18, spring 52, and portions of the first communication line 28 and second communication line 30 may be located in the interior 36.

Figure 5:
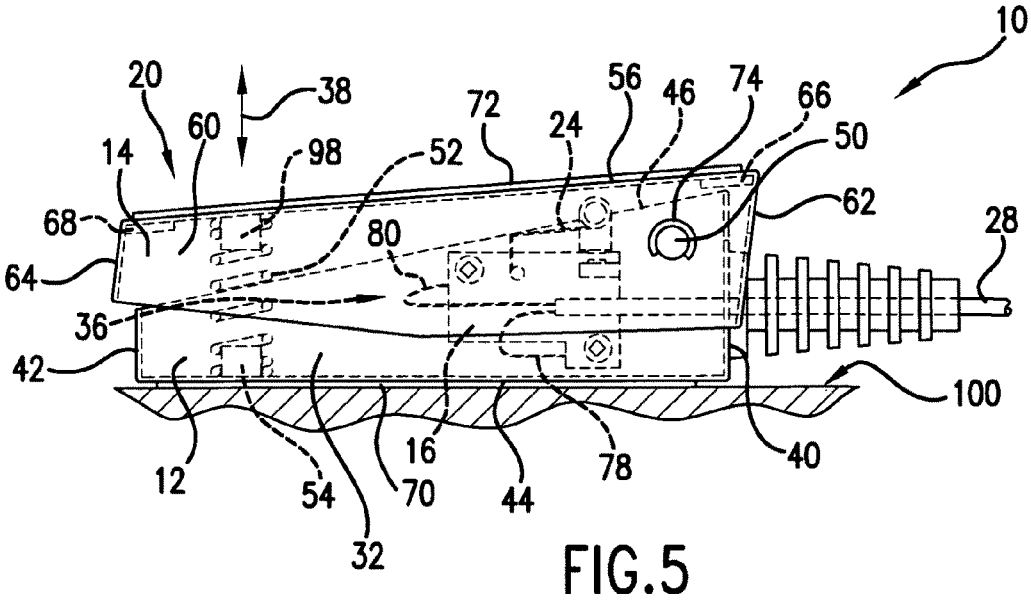
FIG. 5 is a left side view of the sustain foot pedal of FIG. 2 in a first position.
Figure 6:
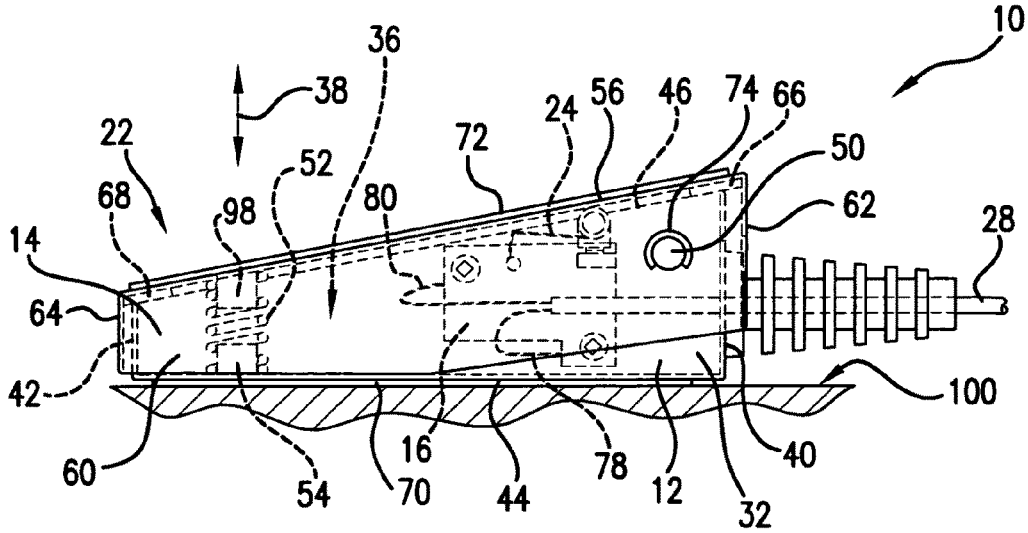
FIG. 6 is a left side view of the sustain foot pedal of FIG. 5 in a second position.

The walls 58, 60, 62 and 64 of the actuating member 14 are spaced farther from one another than the walls 32, 34, 40 and 42 of the body 12 so that the body 12 will nest within the actuating member 14 when the actuating member 14 is actuated. FIGS. 5 and 6 show a left side view of the sustain foot pedal 10. In FIG. 5, the actuating member 14 is in a first position 20 which may be described as an at rest position. The first switch 16 has a first lever 24 that extends upwards beyond an upper edge 46 of the first side wall 32. The first side wall 32 may be sloped so that other portions of the first side wall 32, such as those extending towards the front wall 40, are vertically above the first lever 24. However, the first lever 24 may be located higher in the vertical direction 38 than the portion of the upper edge 46 of the first side wall 32 that is proximate to the first lever 24.

The actuating member 14 may be arranged so that it forms a single, contained cavity into which both of the switches 16 and 18 are fully or partially disposed. The cavity formed by the actuating member 14 may be made so that it is not discontinuous such that the wall 62 and/or 64 is completely continuous from the right side wall 58 to the left side wall 60 such that the walls 62 and/or 64 are not discontinuous. Likewise, the body 12 may be arranged so that it forms a single cavity into which both of the switches 16 and 18 may be disposed. The front wall 40 and/or back wall 42 of the body 12 may be completely continuous and extend from and engage both the first and second side walls 32 and 34. As such, the body 12 and actuating member 14 configuration form a single cavity into which the switches 16 and 18 may be contained so that the switches 16 and 18 may be within a common, single cavity and thus may be disposed so as to face one another. In other embodiments, the switches 16 and 18 may be separated from one another by way of a wall or other components within the foot pedal 10, but may still be located within the same cavity as defined by the various walls of the body 12 and actuating member 14 as previously discussed.

The actuating member 14 may be pivotally connected to the body 12 though the use of a shaft 50. The shaft 50 may have a groove defined thereon that receives a portion of the first side wall 32 and/or left side wall 60 therein. A fastener 74 can be used to help secure the actuating member 14 and/or body 12 to the shaft 50. The spring 52 is biased so that it urges the actuating member 14 away from the body 12. The first lever 24 is not activated and thus the first switch 16 is not activated in the first position 20 illustrated in FIG. 5.

When a musician desires to sustain a note when playing the keyboards 86 and 88, he or she may place his or her foot onto the top wall 56 of the actuating member 14 and apply downward pressure in the vertical direction 38. Doing so will cause the spring 52 to compress and thus cause the actuating member 14 to pivot about the shaft 50 with respect to the body 12. Application of a sufficient amount of force will cause the actuating member 14 to be moved into the second position 22 as illustrated in FIG. 6. Here, the actuating member 14 is moved into a position so that the bottom of the top wall 56 comes into contact with the first lever 24 and forces the first lever 24 downward and below the portion of the upper edge 46 that is proximate to the first lever 24. Pushing the first lever 24 downward will cause the first switch 16 to be activated and thus will open or close the circuit associated with the first switch 16 to inform the first keyboard 86 that the actuating member 14 has been depressed. In the second position 22 the note played by the first keyboard 86 will be sustained. Once the musician desires to stop sustaining the note or notes played by the first keyboard 86, he or she may release pressure on the top of the actuating member 14. Doing so will cause the spring force built up in compressed spring 52 to be released to thus cause the actuating member 14 to be moved from the second position 22 back to the first position 20 of FIG. 5. This will likewise cause the removal of the top wall 56 from contact with the first lever 24. The first lever 24 is itself spring loaded such that the removal of force thereon will cause the first lever 24 to spring back into the position illustrated in FIG.

5 thus opening or closing the first switch 16 depending upon how the first switch 16 is arranged. The first switch 16 will then open or close its associated circuit and thus inform the first keyboard 86 that the actuating member 14 is in the first position 20 and that the notes played by the first keyboard 86 should not be sustained.

Figure 7:
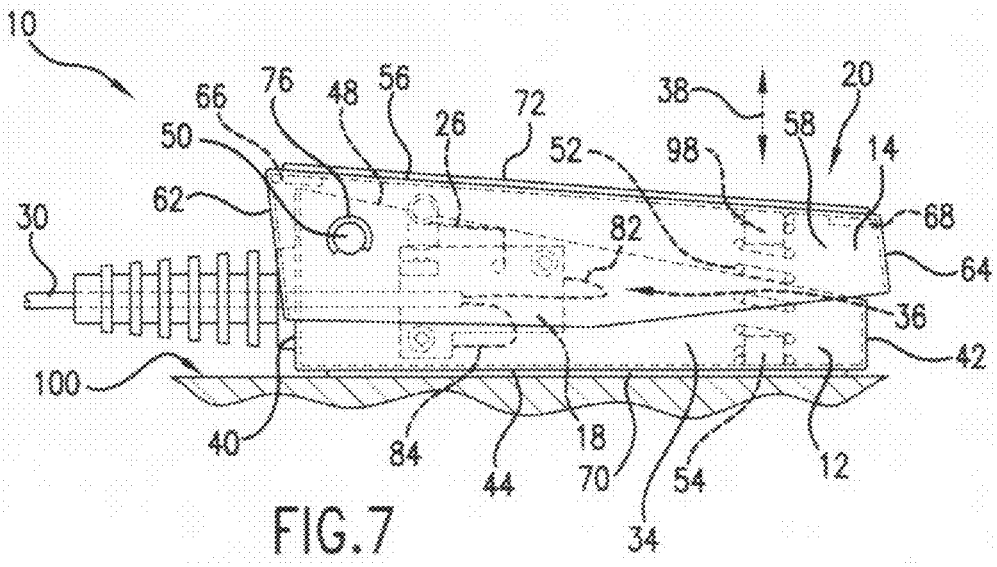
FIG. 7 is a right side view of the sustain foot pedal of FIG. 2 in a first position.
Figure 8:
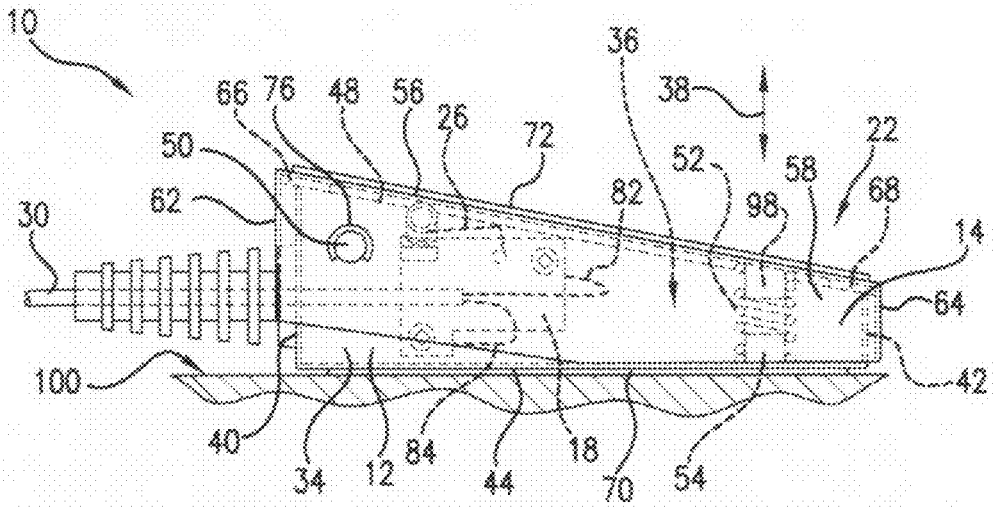
FIG. 8 is a right side view of the sustain foot pedal of FIG. 7 in a second position.

FIGS. 7 and 8 show the right side of the sustain foot pedal 10 when the actuating member 14 is in the first position 20 and is in the second position 22. A fastener 76 is included and is used to help attach the actuating member 14 and body 12 to the shaft 50. The second switch 18 has a second lever 26 that is located above a proximate portion of an upper edge 48 of the second side wall 34 in the vertical direction 38 when the actuating member 14 is in the first position 20. Although other portions of the upper edge 48 may be higher than the second lever 26 when the actuating member 14 is in the first position 20, the portions of the upper edge 48 proximate to the second lever 26 are below the second lever 26 when the actuating member 14 is in the first position 20. As previously explained with respect to the first lever 24 and first switch 16, actuation of the actuating member 14 so that it is moved to the second position 22 causes the second lever 26 to be depressed vertically below the upper edge 48 to thus close or open the second switch 18. The circuit associated with the second switch 18 will thus be opened or closed when the actuating member 14 is moved to the second position 22 depending upon whether this circuit is normally open or normally closed. Removal of pressure on the activating member 14 will cause the spring 52 to force the actuating member 14 back into the first position 20 and thus deactivate the second switch 18. The second lever 26 can be spring loaded to return to the position illustrated in FIG. 7 upon removal of pressure to the actuating member 14 and thus removal of contact with the bottom of the top wall 56. The second switch 18 can be arranged in an identical manner as the first switch 16 and a repeat of this information is not necessary to describe the activation and deactivation of the second switch 18.

The bottom wall 44 of the body 12 may have a slip resistant material 70 located on its bottom surface. The slip resistant material 70 may be made of the same material and arranged in an identical manner as the slip resistant material 72 of the actuating member 14. In other arrangements, the slip resistant material 70 need not be present or may be made of a different material or arranged differently than the slip resistant material 72. The slip resistant material 70 may prevent or reduce movement of the body 12 on a surface 100 onto which the sustain foot pedal 10 is placed.

The first switch 16 and second switch 18 may be arranged so that they are activated and deactivated simultaneously. As such, the first and second signals generated by the first and second switches 16 and 18 respectively are simultaneously sent to the first and second keyboards 86 and 88 so that the keyboards 86 and 88 will always sustain notes together at the same time and so that they will always not sustain notes together at the same time. The sustain foot pedal 10 may be thus arranged so that one of the keyboards 86 or 88 cannot sustain notes while the other keyboard 86 or 88 does sustain notes. As such, the keyboards 86 and 88 are always in sync with one another such that they either both are sustaining notes, or so that they are both neither sustaining notes. The sustain foot pedal 10 is not arranged so that the first keyboard 86 sustains a note while at the same time the second keyboard 88 does not sustain a note. Likewise, the sustain foot pedal 10 is not arranged so that the second keyboard 88 sustains a note at the same time the first keyboard 86 does not sustain a note. In accordance with various exemplary embodiments, the first sustain signal and the second sustain signal are always sent upon actuation of the actuating member 14, and it is never the case that the first sustain signal is sent without simultaneously sending the second sustain signal upon actuation of the actuating member 14.

As described, the body 12 and actuating member 14 may be made of metal and may potentially be electrically conductive. Further, the first switch 16 and second switch 18 may have voltage applied thereto. Although the amount of voltage necessary to send a first signal from the first switch 16 and a second signal from the second switch 18 is minimal, the sustain foot pedal 10 may be arranged to ensure the possibility of even the slightest electrical shock is removed. In this regard, first insulation paper 90 can be disposed around the first switch 16 to prevent it from directly contacting the body 12. The first insulation paper 90 may act as an electrical insulation layer between the first switch 16 and the bottom wall 44 and the first side wall 32. With such an arrangement, electrical discharge from the first switch 16 to the body 12 or activating member 14 so as to shock the musician is completely prevented. Although the first switch 16 may itself be electrically insulated, the presence of the first insulation paper 90 may act as a back up to ensure proper electrical insulation. In a similar manner, the second insulation paper 92 can be used to prevent electrical discharge to the musician by the second switch 18. The second insulation paper 92 may be disposed between the second switch 18 and the bottom wall 44 and the second side wall 34 to prevent electrical discharge or to function as a back up. It is to be understood, however, that the first and second insulation papers 90 and 92 are not present in other arrangements. Further, the wires 78, 80, 82 and 84 may be electrically insulated so that they do not pose a risk of shock to the user during use of the sustain foot pedal.

In accordance with one exemplary embodiment, the sustain foot pedal 10 may be arranged so that the keyboards 86 and 88 are forced to sustain notes at the same time as one another and cannot function so that one keyboard 86 or 88 sustains a note while the other keyboard 86 or 88 could be played and not sustain a note. The first switch 16 may be specific to the first keyboard 86 so that it is capable of sending the correct signal to the first keyboard 86. Further, the second switch 18 can be specific to the second keyboard 88 so that it too can send the correct signal to the second keyboard 88. The first switch 16 may be the same as the second switch 18 in some embodiments or may be different than the second switch 18 in other embodiments depending upon the particular construction/specification of the keyboards 86 and 88. A pair of switches 16 and 18 may be used even when the keyboards 86 and 88 require the exact same signal. In this regard, it may not be advisable to splice the communication lines 28 and 30 to one another so that only a single switch is needed because doing so may cause confusion in the transmitted signal and problems with their receipt at the keyboards 86 and 88. However, certain exemplary embodiments exist in which splicing of the communication lines 28 and 30 may be used to effect communication. Also, it is to be understood that other arrangements are possible in which but a single switch 16 is used to send a sustain signal to the first keyboard 86 and a separate sustain signal to the second keyboard 88. Here, although two separate signals are sent, the signals are generated from a common switch. The switches 16 and 18 can be variously configured in accordance with certain exemplary embodiments. For example, the switches 16 and 18 may be snap action switches in accordance with certain arrangements of the sustain foot pedal 10.

The keyboards 86 and 88 may be arranged so that they do not have an independent means of sustaining notes other than through the use of the sustain foot pedal 10. The keyboards 86 and 88 may each have their own independent sustain button that functions to sustain a note. Further, even if the keyboards 86 and 88 each have their own independent sustain button, they may further have notes sustained through use of the sustain foot pedal 10 which would function as a secondary means to sustain notes when playing the keyboards 86 and 88. The keyboards 86 and 88 may be made by different manufactures and thus need not be at all compatible with one another in any respect. In accordance with certain exemplary embodiments, the sustain foot pedal 10 sends first and second sustain signals to two different keyboards 86 and 88 at the same time in which the signals are not manipulated by a processing unit between the switches 16 and 18 and the plugs 94 and 96 that effect the tonal data for both the first keyboard 86 and the second keyboard 88. The keyboards 86 and 88 are not in data communication with one another or with a common computer. The first signal and second signal may not be processed in any manner, for example by a computer, upon their generation at the first switch 16 and second switch 18 through their transmission in the communication lines 28 and 30 to the plugs 94 and 96 that are attached to the keyboards 86 and 88.

Although described as being input directly to both of the keyboards 86 and 88, other arrangements are possible in which the communication lines 28 and 30 are not directly input to the keyboards 86 and 88. For example, the communication lines 28 and 30 may be input to a device or devices that are then in turn placed into communication with the keyboards 86 and 88 in order to effect their functioning in the aforementioned manner. As such, the plugs 94 and 96 need not be input directly into the keyboards 86 and 88 in accordance with certain exemplary embodiments.

The sustain foot pedal 10 may thus be capable of sustaining a pair of keyboards 86 and 88 through the application of but a single actuating member 14 that can have but a single, generally planar top wall 56. All of the switches 16 and 18 and other components necessary to sustain the keyboard pair 86 and 88 can be found within the single interior 36 defined by the single body 12 and single actuating member 14. The musician need only apply force sufficient to actuate but a single actuating member 14 in order to sustain both keyboards 86 and 88.

Various exemplary embodiments also exist in which the body 12 is not a single member that defines a single interior 36. For example, the body 12 can be made out of two or more separate members that partially define various interiors. In this regard, the body 12 may be two separate components, and the actuating member 14 may be levers pivoted on each of the two separate body components and a bar or other member extending between or otherwise engaging both of the levers. The first switch 16 can be located in one of the body 12 components and the second switch 18 can be located in the other one of the separate body 12 components. The musician may depress the bar or other member that forms a portion of the actuating member 14 so that both of the levers depress to cause the first switch 16 in the first body 12 component to activate, and to cause the second switch 18 in the second body 12 component to activate.

While the present invention has been described in connection with certain preferred embodiments, it is to be understood that the subject matter encompassed by way of the present invention is not to be limited to those specific embodiments. On the contrary, it is intended for the subject matter of the invention to include all alternatives, modifications and equivalents as can be included within the spirit and scope of the following claims.

What is claimed:

1. A system comprising a first and second keyboard and a single pedal, where said single pedal is a sustain foot pedal, said sustain foot pedal comprising:

a body;

a first switch carried by the body;

a second switch carried by the body;

an actuating member capable of being moved from a first position to a second position and back from the second position to the first position, wherein in the second position the actuating member simultaneously activates both the first switch and the second switch, and wherein when the actuating member is in the first position both the first switch and the second switch are deactivated;

a cable having at least one ¼inch plug for connecting with at least one of the first keyboard and second keyboard;

a first communication line in communication with the first switch, wherein when the first switch is activated a first sustain signal is communicated through the first line to the first keyboard to cause the first keyboard to sustain a first note when a key of the first keyboard is depressed by a musician when playing the first keyboard to sustain the first note played; and a second communication line in communication with the second switch, wherein when the second switch is activated a second sustain signal is communicated through the second line to the second keyboard to cause the second keyboard to sustain a second note when a key of the second keyboard is depressed by a musician when playing the second keyboard to sustain the second note played, wherein notes played by the first keyboard and the second keyboard are simultaneously sustained; wherein the first keyboard and the second keyboard are independent from one another, such that the first keyboard and second keyboard do not receive shared signals.

2. The system as set forth in claim 1, wherein the first switch and the second switch are configured to be both normally open, both normally closed, or one of the first and second switches is normally open and the other of the first and second switches is normally closed and wherein the first communication line is not in communication with the second communication line.

3. The system as set forth in claim 1, wherein: the body has a first side wall and a second side wall, wherein the first switch is attached to the first side wall, and wherein the second switch is attached to the second side wall, wherein the first switch and the second switch are located in an interior defined by the body and the actuating member, wherein a first lever of the first switch is located at a vertical height higher than a portion of an upper edge of the first side wall when the actuating member is in the first position, and wherein a second lever of the second switch is located at a vertical height higher than a portion of an upper edge of the second side wall when the actuating member is in the first position; wherein the actuating member is pivotally attached to the body; and further comprising a spring that engages the body and the actuating member, wherein the spring biases the actuating member to the first position.

4. The system as set forth in claim 3, wherein: the first communication line has a pair of wires that are in communication with the first switch and that form a portion of a first circuit that is opened or closed depending upon whether the first switch is activated or deactivated; wherein the body has a front wall that defines an opening, wherein the first communication line and the second communication line are disposed through the opening.

5. A system comprising of a first and second keyboard and a single pedal wherein said single pedal is a sustain foot pedal comprising a cable having at least one ¼inch plug for connecting with at least one of the first keyboard and second keyboard; wherein the first keyboard and second keyboard, are independent from one another such that the first keyboard does not send a signal to the second keyboard to control the second keyboard, and such that the second keyboard, does not send a signal to the first keyboard to control the first keyboard; a first and second communication line, wherein when the single pedal is pressed it activates both a first and second signal simultaneously to cause the first and second keyboards to be controlled by the single pedal; wherein a first switch and second switch are arranged in a housing of the single pedal so that they are activated and deactivated simultaneously to control both the first and second keyboard.

6. A system comprising a first and second keyboard and a single pedal wherein said single pedal is a sustain foot pedal for controlling a first keyboard and a second keyboard said single pedal comprising a cable having at least one ¼inch plug for connecting with at least one of the first keyboard and second keyboard, and further, comprising: a body; an actuating member capable of being moved from a first position with respect to the body to a second position with respect to the body and back from the second position to the first position, wherein the actuation member has a right side wall and a left side wall and an additional wall that is contiguous with and extends from the right side wall to the left side wall; a first communication line, wherein when the actuating member is in the second position a first sustain signal is communicated through the first communication line; a second communication line, wherein when the actuating member is in the second position a second sustain signal is communicated through the second communication line, wherein at least a portion of the first communication line and at least a portion of the second communication line are located between the right side wall and the left side wall of the actuating member;

wherein the first keyboard and the second keyboard are independent from one another such that the first keyboard does not send a signal to the second keyboard to control the second keyboard, and such that the second keyboard does not send a signal to the first keyboard to control the first keyboard, wherein when the single pedal is pressed it activates both the first and second signals simultaneously to cause the first and second keyboards to be controlled by the single pedal; wherein a first switch and second switch are arranged in a housing of the single pedal so that they are activated and deactivated simultaneously to control both the first and second keyboard.

7. The system as set forth in claim 6, wherein a polarity of the switches are either both normally open, both normally closed or one switch is a normally open polarity and one switch is a normally closed polarity; wherein the first switch and second switch are arranged so that they are activated and deactivated simultaneously.

* * * * *